United States Patent [19]

Herzner

[11] 3,972,661

[45] Aug. 3, 1976

[54] ROTARY PISTON ENGINE

[76] Inventor: Hans Herzner, 3579 Schrecksburg, Holzburg, Germany

[22] Filed: July 29, 1975

[21] Appl. No.: 600,105

[30] Foreign Application Priority Data

July 29, 1974 Germany ..... 2436483

[52] U.S. Cl. ..... 418/262

[51] Int. Cl.[2] ..... F04C 21/00

[58] Field of Search ..... 418/138, 241, 260, 261, 418/262, 264

[56] References Cited

UNITED STATES PATENTS

| | | | |
|---|---|---|---|
| 2,151,484 | 3/1939 | Nordling | 418/261 |
| 2,470,656 | 5/1949 | Shorrock | 418/138 |
| 3,200,796 | 8/1965 | Kraic et al. | 418/138 X |

*Primary Examiner*—C. J. Husar
*Assistant Examiner*—Leonard Smith
*Attorney, Agent, or Firm*—Hill, Gross, Simpson, Van Santen, Steadman, Chiara & Simpson

[57] ABSTRACT

Rotary piston devices such as engines, pumps, compressors, etc. having a rotating piston member received in a chamber defining casing with a working member projecting from the piston member into sealing engagement with the chamber defining surface of the casing. The working member is received in a slot in the piston member between two guide members having opposed arcuate surfaces mating with curved surfaces of the working member, the surfaces extending parallel to the axis of rotation of the piston member.

5 Claims, 7 Drawing Figures

ROTARY PISTON ENGINE

BACKGROUND OF THE INVENTION

1. Field of the Invention

This invention relates to rotary piston devices and more particularly to a casing inner diameter contacting seal assembly for such devices.

2. Prior Art

Rotary piston machines, such as rotary engines, pumps, compressors and the like which utilize a piston having an outer diameter configuration which contacts the inner diameter of an enveloping casing at at least one region of the casing are known to the art. It has been common to provide one or more laminar working members in operative engagement with the piston and providing a slidable seal on the inner diameter surface of the casing. Such working members, or sealing members, generally engage plane surfaces on the piston such as, for example, planar slot walls extending into the piston from the periphery thereof which are contacted by planar surfaces on sides of the working member (seal member). In some examples, it has been known to replace the laminar working members or seals with cylindrical seal members which have only a line contact with the planar surface in the piston.

In some prior art machines, it has been known to guide the lower ends of the working members by sliding them on an internal cam surface, the outline of which corresponds to that of the casing inner diameter surface.

Although the use of cylindrical or roller-like working members does avoid producing a tilting moment of the sealing member, with the resultant danger of premature wear which is common with straight or laminar working members having plane surfaces, the line contact parallel with the axis of rotation of the piston is not advantageous for transmitting working pressures from the seal member to the piston and vice versa. In addition, the effectiveness of the seal between the chambers formed by division of the internal space between the casing inner diameter and the piston outer diameter divided by the seal is not adequate.

It would therefore be an advance in the art of rotary piston machines to provide a more effective seal assembly between the inner diameter of the casing and the outer diameter of the piston which avoids the heretofore encountered tilting moment problems of laminar seals while avoiding the less effective sealing problem which arise from prior cylindrical or roller-like seal members.

SUMMARY OF THE INVENTION

It is therefore a primary object of this invention to provide, in a rotary piston engine of the type herein described, a construction of the working members or seal members and their associating guiding parts which guide them in the piston which will neutralize any tilting moments of the seal which are likely to occur while obtaining a reliable sealing of the seal members in the piston and on the casing inner diameter surface.

In accordance with the teachings of this invention, these objects are obtained by positioning each working member or seal member between two separate parts or guide members. The mutual contacting surfaces of the seal member and the guide members are coaxially arcuately curved with the guide members being adapted to carry out rocking motion in directions opposite to one another about a common axis or about separate parallel axis. The oppositely rocking movement of the guide members creates a thrust of varying direction on the seal member which is controlled in accordance with the relation of the opposed portion of the casing inner diameter surface to the axis of the piston.

In other words, the guide members in an illustrated embodiment, are crescent shaped and the seal member is given a corresponding biconvex form. This type of construction heretofore has not been used in association with rotary piston machines for sealing purposes although similar devices have been utilized in reciprocating piston engines which undergo kinematic reversal of movement and for other purposes.

One advantage of this invention, in addition to the above, is the possibility of superimposing a codirectional rocking movement in a simple manner on the opposed direction rocking movement of the guide members. In this manner the longitudinal axis of the working member or seal member will always be directed perpendicularly to the casing inner diameter surface.

In order to impose such a control on the movement of the guide members, it is possible to use a cam track in or at one housing side wall or both of the housing side walls which define the chambers at the axial ends of the pistons. The guide members are preferably each arranged on a circular disc at an axial end thereof which carries an external pivot pin or the like which may be offset by approximately 180° relative to the guide member. The pivot pin then acts as an element engaging in the associated cam track. By this construction the cam track and the casing surface will have a somewhat identical path. The provision of the circular disc at the axial end of the guide members also functions to provide a very good side seal for the entire seal assembly, which consists of the seal member and its associated guide members in the piston, particularly with respect to the housing side walls.

As an alternative, the pivot pin or the element which engages in the cam track need not be offset relative to the guide part. In such an instance, if the casing is composed of concavely arcuate surfaces of identical length, the cam track will then take the shape of a regular polygon whose points are each situated on the connecting lines between the casing axis and the points on the casing surface which are furthest from the axis.

Further, in place of the cam tracks, a crank mechanism can be utilized, however this is a possibility substantially only with a machine having at the most two working members per piston. Additionally, the casing surface must not extend about the piston axis on a curve of a higher order than can be simulated by such a mechanism.

It is therefore an object of this invention to provide a rotary piston machine having a piston received in a casing with a seal member extending from an outer periphery of the piston into engagement with the inner diameter of the casing, the seal member having curved surfaces mating with arcuate surfaces of guide members.

It is another and more specific object of this invention to provide a rotary piston machine wherein the piston to casing inner diameter seal is maintained through a sealing assembly consisting of two opposed rocking guide members having opposed surfaces of opposite arcuate curvature with a seal member having curved surfaces engaging the guide member surfaces, the guide members being guided for oscillatory movement with respect to the piston and allowing movement of the seal member in conformity with the inner diameter configuration of the casing.

Other objects, features and advantages of the invention will be readily apparent from the following description of a preferred embodiment thereof, taken thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
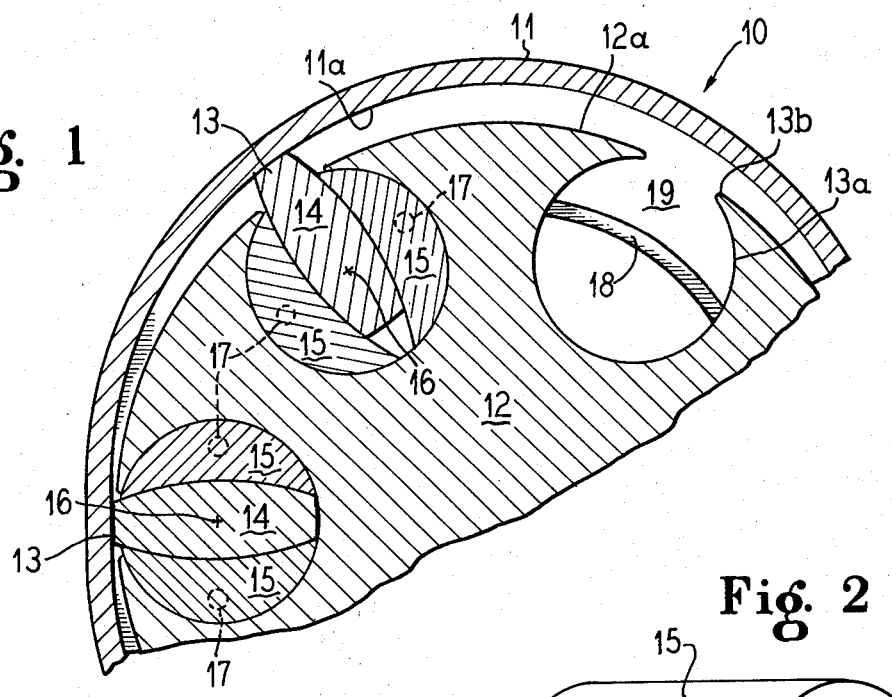
FIG. 1 is a fragmentary cross-sectional view of a rotary piston engine equipped with the seal assembly of this invention.

FIG. 1 illustrates a rotating piston machine 10 including a casing 11, which may, in the illustrated embodiment, have an inner diameter surface 11*a* with a dual mating curved configuration. Piston 12 has an outer diameter surface 12*a*, received within the casing and has a plurality of seal assemblies 13 located around the outer diameter with portions thereof being received in axially extending slots 13*a* which are open at 13*b* to the outer diameter 12*a*. The seal assemblies 13 each include a seal member 14 and two guide members 15. The individual working members or seal members 14 are guided between opposed surfaces of the guide members 15 with the contacting surfaces of the seal members 14 and the guide members being cooperatively coaxially curved as illustrated.

The guide members 15 are adapted to move with a rocking motion, about a common axis 16 in the illustrated embodiment. Each guide member 15 has a pivot pin 17, or cam track engaging member, which engages in a cam track 18 in an end or side wall 19 of the machine housing. The cam track 18, through the agency of the pivot pin 17, operates upon the guide member 15 to control the working movement of the working member or seal member 14 in such a manner that it will always slide with a positive seal on the inner diameter 11*a* of the casing 11. If separate cam tracks are provided for the guide members 15 of each seal assembly 13, the movement of the guide members rocking in opposite directions can have a codirectional rocking movement superimposed thereon which result in assuring that the longitudinal axis of the seal member 14 will always be maintained perpendicular to the inner diameter surface 11*a* of the casing.

Figure 2:
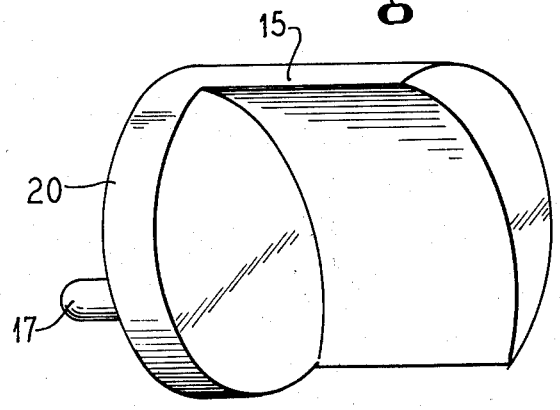
FIG. 2 is a perspective view of a guide member of the seal assembly of this invention.

As shown in FIG. 2 each of the individual guide parts 15 are formed as a projection from one side of a disc 20 which has the pivot pin 17 projecting from the other side approximately 180° from the main projection of the guide member 15. Because of this arrangement, the two control cam tracks, when used, will extend along a substantially identical course to the shape of the inner diameter 11*a* of the casing about the axis.

Figure 4:
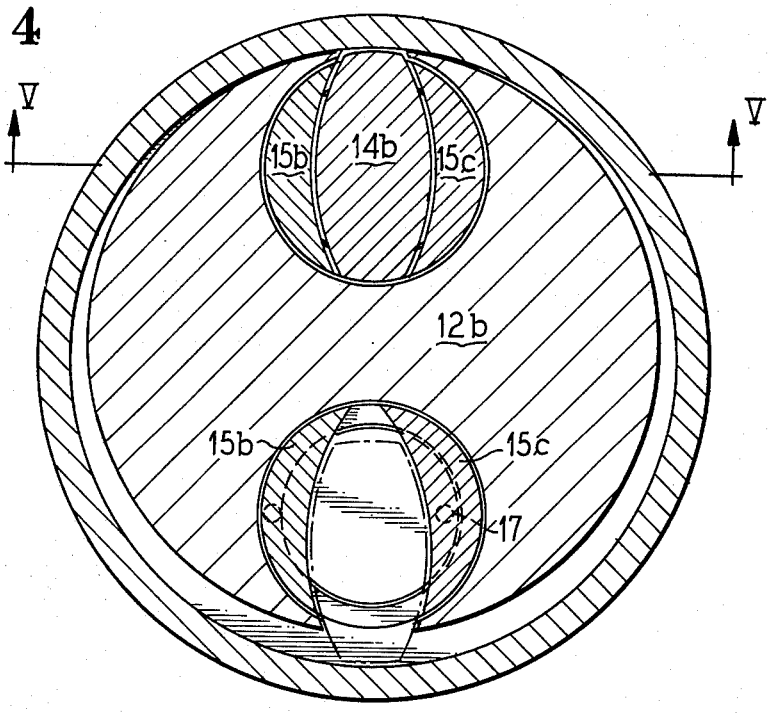
FIG. 4 is a cross-sectional view of a rotary piston engine illustrating yet another modified form of the seal assembly of this invention.
Figure 5:
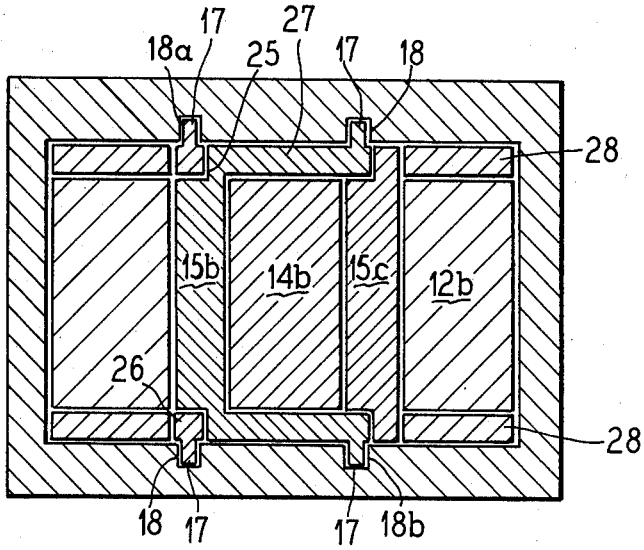
FIG. 5 is a cross-section view taken along lines V-V of FIG. 4.

However in the case of a very wide cylindrical piston, the use of the disc shape projection guide member illustrated in FIG. 2 can be disadvantageous. As shown in FIGS. 4 and 5, the guide members 15*b* can then be formed with two pivot pins 17 which are guided in opposed end wall cam tracks 18*a* and 18*b*. In this construction the seal member 14*b* is received inwardly of the end portions of the guide member 15*b* with the pivots for the guide member 15*b* projecting from the end portions, the end portions of the guide member 15*b* are stepped as at 25. The pivot pins 17 for the guide member 15*c* are formed as projections from ring members 26 which are received around the end portions of the guide member 15*b* and which insert in the recesses 25. Thus the end portions 27 of the guide member 15*b* formed as centrally rotatable circular discs received inside of rings 26 of the guide member 15*c*. In this embodiment spacer rings 28 may be interposed at the axial ends of the piston 12*b*.

Figure 3:
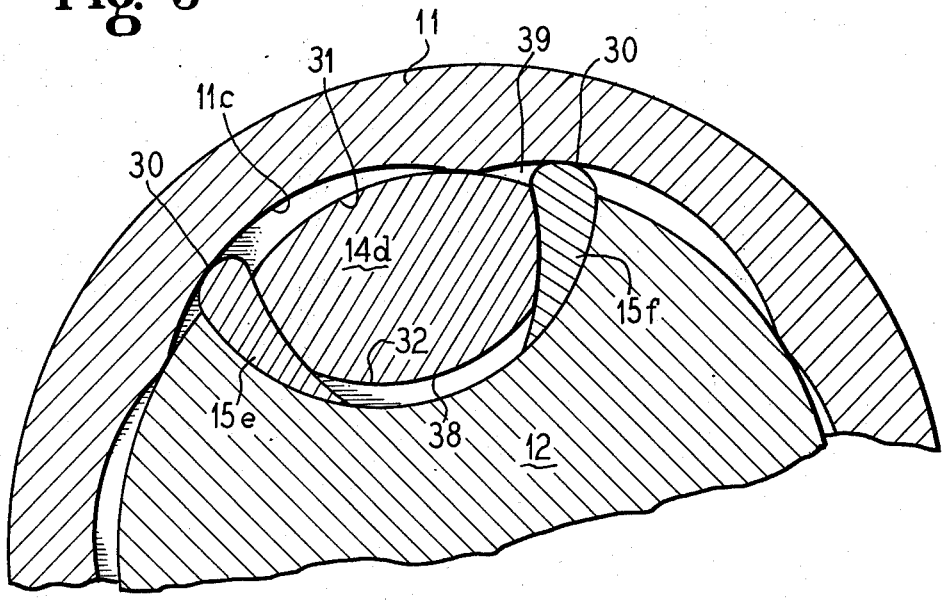
FIG. 3 is a fragmentary cross-sectional view of a modified form of the seal assembly of this invention.

As a further alternative as shown in FIG. 3 it is possible to use the inner diameter surface 11*c* of the casing 11 as the control cam track. In the construction shown in FIG. 3 the inner diameter surface 11*c* may be composed of 6 identically concavely curved arcuate subsurfaces, the guide members 15*e* and 15*f* are formed with a cross-sectional shape which can be somewhat described as a transverse division of the crescent shaped guide members shown in FIG. 1. In such a construction, the guide members extend outwardly beyond the outer diameter of the piston and each will slide with a convexly curved head surface 30 on the casing inner surface 11*c*. Since, measured at the casing surface 11*c*, the mean spacing between the two guide members 15*e* and 15*f*, that is to say the straight line spacing between the crest lines of their head surfaces 30, is substantially equal to the length of an individual arc of the subsurfaces of the casing, and since the convexly curved head surface 31 of the seal member 14*d* has the same radius of curvature as the individual subsurface casing arcs of the surface 11*c*, the seal member 14*d* and the associated guide parts 15*e* and 15*f* will always be guided on the surface 11*c*. That surface will therefore alternately exert inward directional pressures on the guide members 15*e* and 15*f* and the seal 14*b*. This alternate exertion of pressures will cause the other parts of the seal assembly to carry out on opposite directional movement.

Therefore, as illustrated in FIG. 3, if it is assumed that the piston is rotating clockwise, an inwardly directed pressure will be placed on the surface 31 of the seal member 14*d* therefore causing an equivalent outward pressure on the guide members 15*e* and 15*f*. Conversely, if it is assumed that the direction of rotation of the piston is counterclockwise, the inward directed pressure from the surface 11*c* will be against the head 30 of the guide members causing them to move inwardly producing a corresponding outward movement of the seal member 14*d*.

Figure 7:
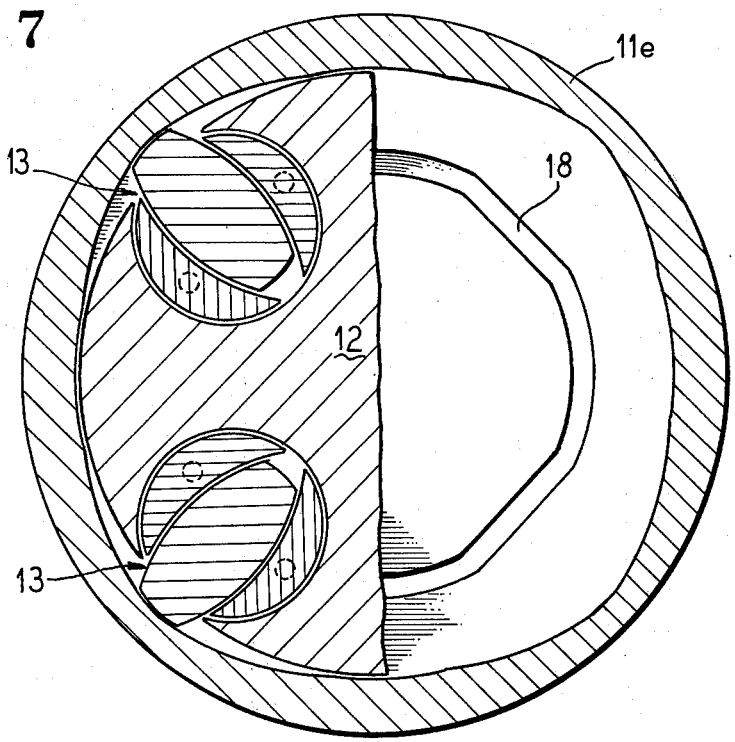
FIGS. 6 and 7 are fragmentary cross-sectional views of rotary piston machines equipped with the seal assemblies of this invention illustrating different cam track and casing inner diameter surface configurations.
Figure 6:
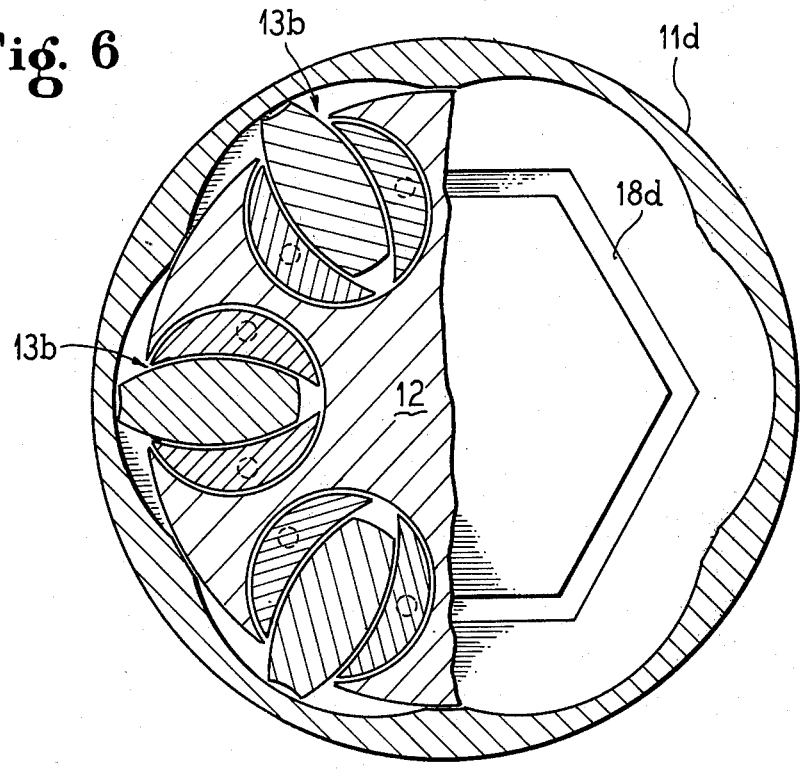

FIG. 6 illustrates a six lobed inner diameter surface casing 11*d* which is provided with seal assemblies 13*b* which have their pivot pins formed as direct projections of the guide members rather than being offset 180°. In such a situation, the cam track 18*d* will take the form of a regular polygon as described above. FIG. 7 illustrates the type of cam track 18 which may be utilized in connection with a four lobed inner surface 11*e* wherein the piston has seal assemblies 13 utilizing the offset pivot pin of FIG. 2.

A further advantage of the type of constructions herein illustrated is that, if desired, the spaces 38 and 39, as shown in FIG. 3, which are formed above the head surface 31 and below the foot surface 32 of the seal member 14*d* can be used as additional working chambers in that they are alternately enlarged and reduced while being sealed by the guide members.

While the embodiment illustrated in FIG. 3 has the guide members formed somewhat as a transverse division of the crescent shaped guide parts of FIG. 1, the entire seal assembly can be constructed non-symmetrically if desired. For example a seal assembly composed of a seal member and guide members may be transversely divided in an oblique manner contrary to the teachings of FIG. 3. This will have the effect of changing the direction of force application.

It should be appreciated that although I have herein shown examples utilizing rotating pistons received in stationary casings, the teachings of this invention are equally applicable to rotating casings and stationary pistons.

It can therefore be seen from the above that my invention provides a rotary piston machine wherein the piston is provided with radially extending seal assemblies which have portions thereof in sliding sealing engagement with the inner diameter surface of the casing. The seal assemblies consist of primary seal members having opposed arcuately curved surfaces which are received in piston grooves between guide members which have opposed surfaces mating with the arcuate surfaces of the seal member. The guide members undergo opposite oscillating rocking movements accomodating radial movement of the seal member while maintaining opposed surface contact with this seal member.

Although the teachings of my invention have herein been discussed with reference to specific theories and embodiments, it is to be understood that these are by way of illustration only and that others may wish to utilize my invention in different designs or applications.

I claim as my invention:

1. A rotary piston engine comprising a piston received within an encircling casing which has a variously configured inner surface, the piston rotatable relative to the inner surface, the piston having an outer surface which is closely spaced from the inner surface of at least one circumferential region of the inner surface, seal means carried by said piston, the seal means including a curved wall groove in the piston substantially parallel to the axis of the piston open to the outer diameter of the piston, a seal assembly within said groove, the seal assembly including a seal member projecting from the said groove into sliding engagement with the inner surface of the casing and two guide members extending parallel with the seal member, the seal member having opposed convex surfaces, the guide members having opposed concave surfaces mating with the convex surfaces, the mating surfaces being struck from a common axis, the guide members tiltable in said piston to produce opposite rocking movements to one another, the opposite movements imparting a thrust on said seal member towards and away from the casing inner surface, and means controlling tilting of the guide members.

2. A rotary piston machine comprising a piston rotating relative to an encircling casing having a variously configured inner surface opposite a piston outer surface, the piston outer surface closely spaced from the casing inner surface at at least one region of the casing, at least one seal member in operative engagement with the piston and projecting from the outer surface and sliding with a sealing action on the casing inner surface, the individual seal member guided in the piston between two separate guide members which are adapted to carry out a rocking movement in opposite directions, mutually contacting surfaces of the seal member and the guide members being coaxially arcuately curved, the oppositely directed rocking movement of the guide members exerting a thrust of varying direction on the seal member, and means controlling the rocking of the guide members in accordance with the configuration of the casing inner surface with respect to an axis of the piston.

3. The machine of claim 2 wherein the casing inner surface is composed of identically concavely curved arcuate surfaces, the guide members sliding on the casing inner surface and the mean spacing between the guide members measured at the casing surface is approximately equal to the length of the arc of one of the identical concavely curved arcuate surfaces.

4. The machine of claim 2 wherein at least 1 cam track is provided at at least one housing side wall closing the casing and a pivot member is provided on each guide member engaging in a cam track for controlling movement of the guide member.

5. The machine of claim 4 wherein each guide member is arranged on a circular disc projecting from one surface thereof with the pivot member projecting from an opposed surface thereof, the pivot member offset relative to the guide member by approximately 180°.

* * * * *